US006537100B2

(12) United States Patent
Moden

(10) Patent No.: US 6,537,100 B2
(45) **Date of Patent: *Mar. 25, 2003**

(54) APPARATUS AND METHOD FOR PACKAGING CIRCUITS

(75) Inventor: Walter L. Moden, Meridian, ID (US)

(73) Assignee: Micron Technology, Inc., Boise, ID (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/196,103

(22) Filed: Jul. 15, 2002

(65) Prior Publication Data

US 2002/0182926 A1 Dec. 5, 2002

Related U.S. Application Data

(63) Continuation of application No. 09/261,608, filed on Feb. 26, 1999, now Pat. No. 6,419,517.

(51) Int. Cl.[7] ..... H01R 13/64

(52) U.S. Cl. ..... 439/377; 429/630; 429/633; 361/791; 361/801

(58) Field of Search ..... 439/377, 64, 630, 439/633, 632, 637, 931; 361/741, 801, 802, 704

(56) References Cited

U.S. PATENT DOCUMENTS

| | | | | | |
|---|---|---|---|---|---|
| 3,364,458 | A | | 1/1968 | Black, Jr. et al. | 339/184 |
| 4,744,764 | A | * | 5/1988 | Rubenstein | 439/62 |
| 4,781,612 | A | | 11/1988 | Thrush | 439/328 |
| 4,892,487 | A | | 1/1990 | Dranchak et al. | 439/260 |
| 4,995,825 | A | | 2/1991 | Korsunsky et al. | 439/328 |
| 5,040,997 | A | | 8/1991 | Garner | 439/77 |
| 5,186,632 | A | * | 2/1993 | Horton et al. | 439/67 |
| 5,209,675 | A | | 5/1993 | Kirsunsky | 439/326 |
| 5,244,403 | A | | 9/1993 | Smith et al. | 439/326 |
| 5,256,078 | A | | 10/1993 | Lwee et al. | 439/326 |
| 5,266,833 | A | | 11/1993 | Capps | 257/690 |
| 5,335,146 | A | * | 8/1994 | Stucke | 361/785 |
| RE34,794 | E | | 11/1994 | Farnworth | 257/678 |
| 5,360,992 | A | | 11/1994 | Lowrey et al. | 257/666 |
| 5,403,202 | A | | 4/1995 | Roehling | 439/493 |
| 5,444,304 | A | | 8/1995 | Hara et al. | 257/796 |
| 5,450,289 | A | | 9/1995 | Kweon et al. | 361/773 |
| 5,451,815 | A | | 9/1995 | Taniguchi et al. | 257/696 |
| 5,592,019 | A | | 1/1997 | Ueda et al. | 257/666 |
| 5,593,927 | A | | 1/1997 | Farnworth et al. | 437/209 |
| 5,635,760 | A | | 6/1997 | Ishikawa | 257/692 |
| 5,642,261 | A | | 6/1997 | Bond et al. | 361/704 |
| 5,668,409 | A | | 9/1997 | Gaul | 257/723 |
| 5,748,426 | A | * | 5/1998 | Bedingfield et al. | 361/58 |
| 5,872,701 | A | | 2/1999 | Hayden, Sr. et al. | 361/786 |

(List continued on next page.)

OTHER PUBLICATIONS

Kinsman, L..D., et al., "Vertical Surface Mount Assembly And Methods", U.S. patent applicaton Ser. No. 6,087,723, Micron Technology, Inc., (Filed Mar. 30, 1998), 31 p.

*Primary Examiner*—Gary Paumen
*Assistant Examiner*—James R. Harvey
(74) *Attorney, Agent, or Firm*—Schwegman, Lundberg, Woessner & Kluth, P.A.

(57) ABSTRACT

The invention relates to a circuit package comprising a module and a socket which cooperate to provide quick and easy insertion of the module into the socket using a small insertion force, accurate alignment between the module and the socket after insertion, and coupling between a module coupling site and a socket coupling site after insertion. A socket guide feature allows an edge of the module to slide along the guide feature during insertion of the module into the socket, and a module alignment feature interlocks with a socket alignment feature after insertion of the module into the socket. In addition, after insertion of the module into the socket, a retaining feature restricts the motion of the module so that the module coupling site remains in contact with the socket coupling site.

81 Claims, 3 Drawing Sheets

U.S. PATENT DOCUMENTS 6,030,251 A 2/2000 Stark et al. ..... 439/377
6,087,723 A * 7/2000 Kinsman et al. ..... 257/727
6,115,254 A 9/2000 Kinsman et al. ..... 361/704
6,134,111 A 10/2000 Kinsman et al. ..... 361/704
6,215,183 B1 * 4/2001 Kinsman et al. ..... 257/727
6,228,677 B1 * 5/2001 Kinsman et al. ..... 438/107
6,437,435 B1 * 8/2002 Kinsman et al. ..... 257/693
6,455,351 B2 * 9/2002 Kinsman et al. ..... 438/107

* cited by examiner

APPARATUS AND METHOD FOR PACKAGING CIRCUITS

This application is a Continuation of U.S. application Ser. No. 09/261,608, filed Feb. 26, 1999 now U.S. Pat. No. 6,419,517 which is incorporated herein by reference.

FIELD OF THE INVENTION

This invention relates to electronic systems, and more particularly, it relates to circuit packaging in electronic systems.

BACKGROUND OF THE INVENTION

A personal computer is one example of an electronic system that is constantly being upgraded. Upgrading a personal computer often requires following a complex procedure and using specialized tools. For example, in some personal computers, the process for adding memory modules requires the use of a soldering iron and performing a sequence of operations to secure each memory module to the memory board. Processes that require following a complex procedure and using a soldering iron tend to intimidate many computer users. So, adding memory modules to a personal computer during the upgrade of a personal computer is often performed by a skilled technician. Unfortunately, using a skilled technician to upgrade a personal computer makes the process very expensive.

Memory upgrade kits exist for some types of personal computers. These kits include memory modules mounted on a printed circuit board. One edge of the printed circuit board has conducting pins for insertion into a matching connector mounted on the memory board. At first glance, for personal computers that support these memory upgrade kits, it appears that adding memory modules to a personal computer using an upgrade kit is a process that is easily performed. Unfortunately, many personal computer users are unable to successfully add memory to their computers using these kits. Users often use an excessive amount of force while attempting to insert the printed circuit board into the matching connector or fail to accurately align memory module pins with the matching connector on the memory board. Using excessive force or failing to accurately align memory module pins with the matching connector often results in broken printed circuit boards and broken memory module pins.

For these and other reasons there is a need for the present invention.

SUMMARY OF THE INVENTION

The above mentioned problems with packaging circuits and other problems are addressed by the present invention and will be understood by reading and studying the following specification. An apparatus and method for packaging circuits is described.

In one embodiment, an apparatus includes a module and a socket. The module has an edge, a coupling site, and an alignment feature located along the edge. The socket has an edge, an alignment feature, a guide, and a coupling site. The guide is located along the socket edge and is capable of guiding the module alignment feature into contact with the socket alignment feature as the module is inserted into the socket. During this insertion process, the module edge is in contact with the guide, and the module coupling site is capable of contacting the socket coupling site when the module alignment feature interlocks with the socket alignment feature.

In another embodiment, an apparatus includes a substrate, a chip, and a socket. The substrate has an alignment feature, and the chip is mounted on the substrate. The socket has an alignment feature, a guide, and a retaining feature. The socket is capable of receiving the substrate and aligning the substrate to the socket using the guide, capable of restricting the lateral motion of the substrate using the retaining feature, and capable of interlocking with the substrate by interlocking the socket alignment feature with the substrate alignment feature while using only a small insertion force.

In another embodiment, a method of adding integrated circuits to a system includes aligning and sliding operations. In the aligning operation, an edge of a module having an alignment feature is aligned with a guide feature of a socket having an alignment feature. In the sliding operation, the edge of the module slides along the guide feature until the module alignment feature interlocks with the socket alignment feature.

In another embodiment, a method of adding integrated circuits to a system includes grasping, aligning, sliding and releasing operations. In the grasping operation, a module is grasped. In the aligning operation, an edge of the module is aligned with a guide feature of a socket. In the sliding operation, the edge of the module slides along the guide feature until a module alignment feature interlocks with a socket alignment feature. In the releasing operation, the module is released.

DETAILED DESCRIPTION OF PREFERRED EMBODIMENTS

In the following detailed description of the preferred embodiments, reference is made to the accompanying drawings which form a part hereof, and in which is shown by way of illustration specific preferred embodiments in which the invention may be practiced. These embodiments are described in sufficient detail to enable those skilled in the art to practice the invention, and it is to be understood that other embodiments may be utilized and that logical, mechanical and electrical changes may be made without departing from the spirit and scope of the present inventions. The following detailed description is, therefore, not to be taken in a limiting sense, and the scope of the present invention is defined only by the appended claims.

Figure 1:
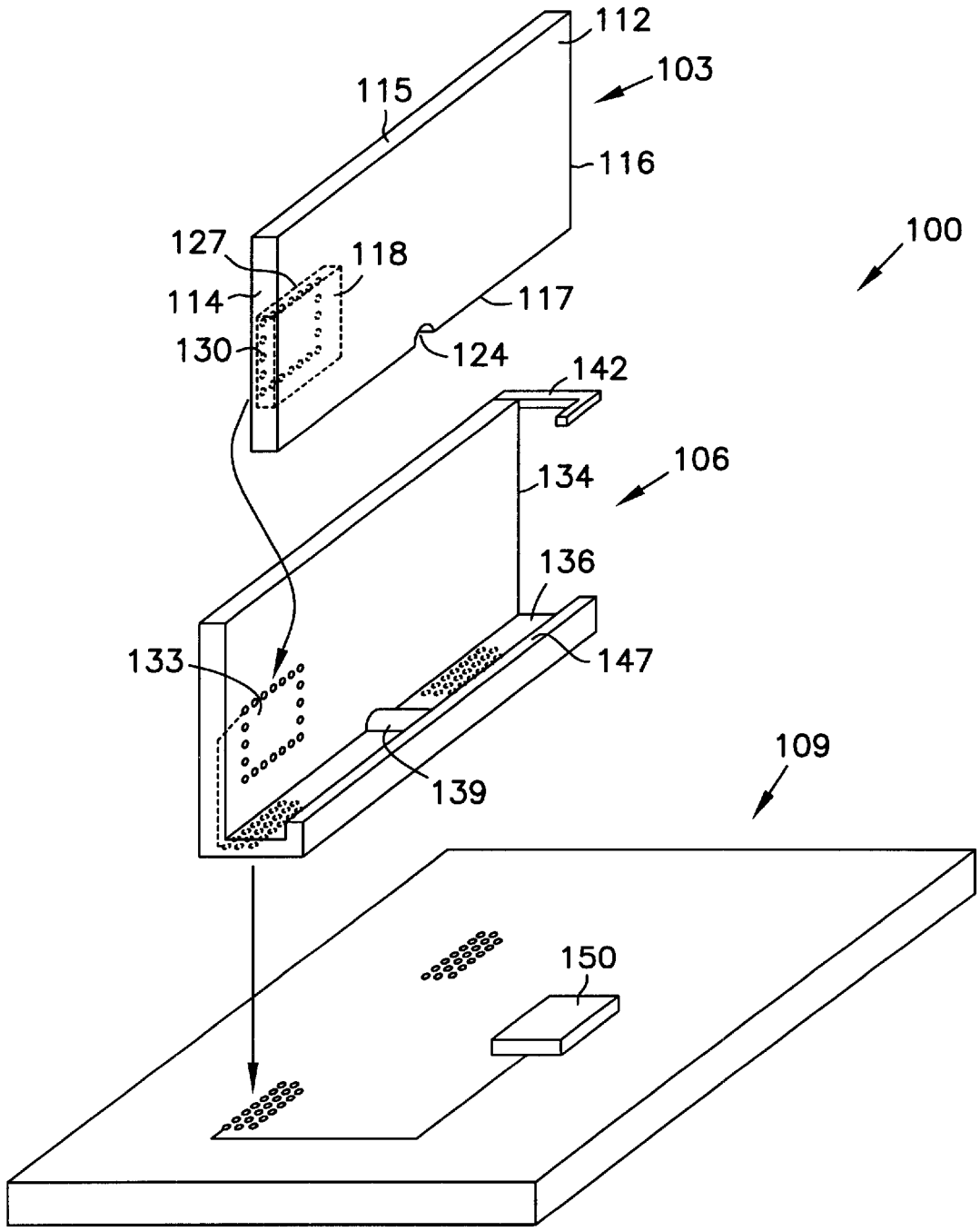
FIG. 1 is an exploded perspective view of some embodiments of a chip carrier system of the present invention.

FIG. 1 shows an exploded perspective view of some embodiments of chip carrier system 100 which comprises two basic components, module 103 and socket 106. FIG. 1 also shows printed circuit board 109 on which chip carrier system 100 can be mounted. Although chip carrier system 100 is capable of packaging and interconnecting a variety of integrated circuits, such as analog circuits, mixed signal application specific circuits, and digital circuits, it is particularly suited through its modular embodiment to applications involving the packaging of memory circuits.

Module 103, in one embodiment, comprises substrate 112, edges 114, 115, 116, and 117, chip 118, and alignment feature 124.

Chip 118 is mounted on substrate 112. Substrate 112, in one embodiment, is made of a conducting material, such as copper, aluminum or gold, or an alloy of such a conducting material. One function of substrate 112 is to transfer heat away from chip 118. Fabricating substrate 112 from a material that is not a good conductor can lead to the catastrophic failure of chip 118, if the material selected for substrate 112 fails to efficiently transfer heat away from chip 118.

Chip 118, in one embodiment, is mounted face down on substrate 112, and is secured to substrate 112 using a heat conducting adhesive. The heat conducting adhesive provides a path for the heat generated by chip 118 to flow into substrate 112. The rate at which heat is removed from chip 118 can be increased by directing air flow across the surface of substrate 112.

Chip 118 includes coupling site 127, which in one embodiment comprises contact pads 130. Contact pads 130 provide a direct connection to the circuits and devices on chip 118. In an alternate embodiment, coupling site 127 comprises pins or other similar connectors, and these pins or other similar connectors are in turn coupled to contact pads 130.

Edges 114, 115, 116 and 117 are preferably planar surfaces. A planar surface makes substrate 112 simple to manufacture, easy to grasp, and permits quick insertion of module 103 into socket 106.

Alignment feature 124 is used to register module 103 with socket 106. When module 103 is registered with socket 106 module coupling site 127 is aligned with socket coupling site 133. Alignment of module coupling site 127 with socket coupling site 133 permits communication between chip 118 and the circuits, chips or devices located on circuit board 109 or coupled to circuit board 109. Failure to align module coupling site 127 to socket coupling site 133 may result in the isolation of chip 118 from the circuits, chips or devices located on circuit board 109.

Alignment feature 124, in one embodiment, is a curved indentation or notch capable of interlocking with a half-cylinder, which is the corresponding alignment feature located on socket 106. This configuration of alignment features permits the insertion of module 103 into socket 106 using a low or zero insertion force, yet restricts the motion of module 103 with respect to socket 106 in the non-lateral direction. Restricting the motion of module 103 in the non-lateral direction ensures the continued alignment of coupling site 127 with socket coupling site 133.

Socket 106, in one embodiment, comprises edge 134, surface 136, alignment feature 139, guide 142, socket coupling site 133, and retaining feature 147. Socket 106 is preferably an injection molded component made of nylon or any other suitable plastic material. Alternatively, socket 106 can be machined from a single piece of plastic or other appropriate material.

Guide 142 is located along edge 134 of socket 106. Guide 142, in one embodiment, has the shape of an el, as shown in FIG. 1, and can be fabricated as an integrated component of socket 106. El shaped guide 142 provides for quick, easy and accurate insertion of module 103 into guide 142. Once inserted into guide 142, module 103 slides along the inside edge of guide 142 until it is seated in socket 106. An advantage of this embodiment is that an untrained person can successfully insert module 103 into socket 106 without damaging components of either module 103 or socket 106.

Alignment feature 139 interlocks with module alignment feature 124. In one embodiment, alignment feature 139 has a smooth shape, such as the shape of a half cylinder as shown in FIG. 1. Using a half cylinder shape, which lacks sharp corners, for alignment feature 139 makes the final alignment and interlocking of module 103 with socket 106 an easy operation to perform. Module 103 slides easily into place once module alignment feature 124 engages socket alignment feature 139, since there are no sharp corners to interfere with the interlocking of module alignment feature 124 with socket alignment feature 139. The present invention is not limited to alignment feature 139 having a half cylinder shape. Other shapes will also permit easy insertion of module 103 into socket 106.

Socket alignment feature 139 is approximately centered along the longest dimension of surface 136 of socket 106, and is preferably fabricated as an integrated component of socket 106. Centering socket alignment feature 139 makes the operation of inserting module 103 into socket 106 and interlocking module 103 with module 106 easier than if the socket alignment feature 139 is located off center. Socket alignment feature 139 also serves to restrict the non-lateral motion of module 103, which keeps module coupling site 127 aligned with socket coupling site 133.

Retaining feature 147 restricts the lateral motion of module 103. In one embodiment, retaining feature 147 is a lip located along an edge of surface 136. Restricting the lateral motion of module 103 forces module coupling site 127 to stay coupled to socket coupling site 133. The location of retaining feature 147 and the amount to which the lateral motion of module 103 is restricted is determined by the characteristics of module coupling site 127 and socket coupling site 133. If module coupling site 127 comprises pads on an integrated circuit chip, and coupling site 133 comprises contacts for those pads, then the proper amount of restriction is achieved by having retaining feature 147 located such that module 103 couples to socket 106 with an amount of force equivalent to a press fit. As with guide 142, retaining feature 139 is preferably fabricated as an integrated component of socket 106.

Printed circuit board 109 provides a platform for mounting socket 106, and a platform on which other circuit modules, such as circuit module 150, can be mounted and coupled to socket 106. The present invention is not limited to a particular type of printed circuit board technology. Socket 106 can be mounted on a single or multilayer board, and can be secured to the board using an adhesive. Alternatively, socket 106 can be secured to the board using an epoxy.

Figure 2:
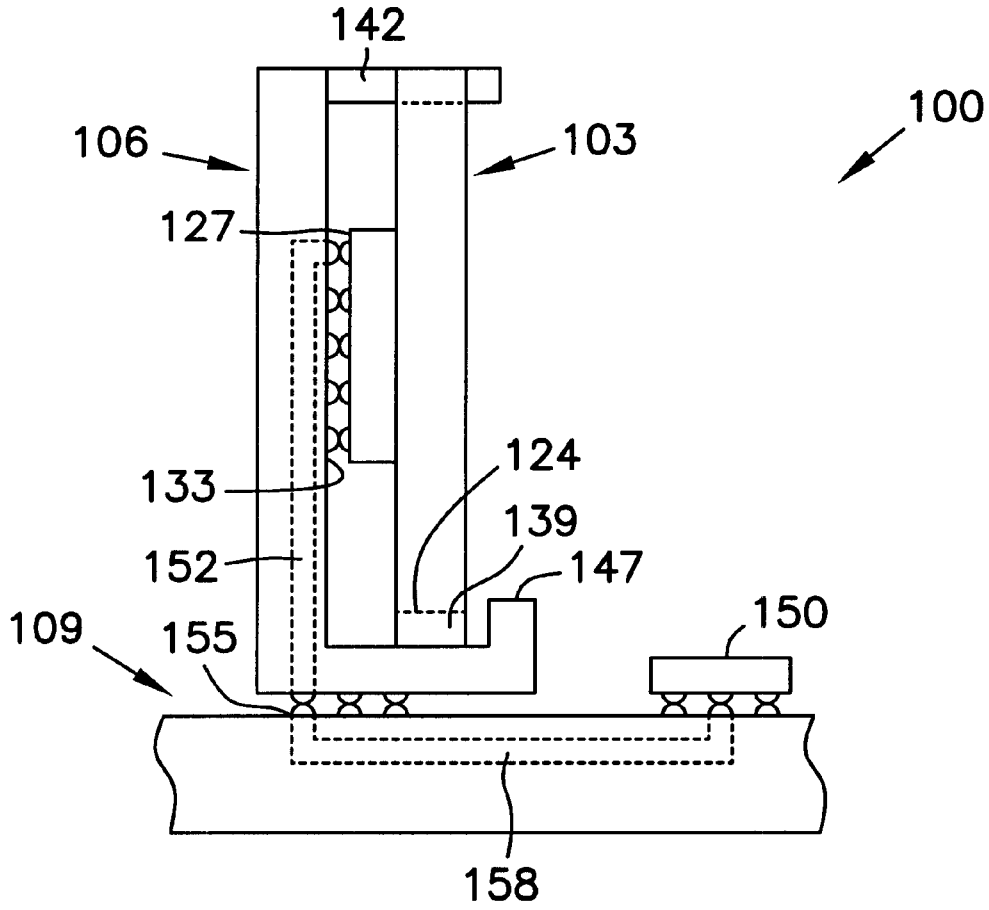
FIG. 2 is a side view of some embodiments of an assembled chip carrier system of the present invention.

FIG. 2 is a side view of some embodiments of an assembled chip carrier system 100 of the present invention. Module 103 is assembled with socket 106 using a press fit, and the assembled chip carrier system 100 is mounted on printed circuit board 109. In the embodiments shown, module 103 is interlocked with socket 106 at module alignment feature 124 and socket alignment feature 139.

The seating and retention of module 103 in socket 106 is best understood by describing the functioning of socket alignment feature 139, module alignment feature 124, retaining feature 147, and guide 142 in the assembled chip carrier system 100. Socket alignment feature 139 and module alignment feature 124 restrict the non-lateral motion of module 103 once socket alignment feature 139 is interlocked with module alignment feature 124. Retaining feature 147 abuts module 103, and ensures that socket coupling site 133 is in contact with module coupling site 127 by restricting the lateral motion of module 103 after module 103 is seated in socket 106. Guide 142 assists retaining feature 147 in keeping module coupling site 127 in contact with socket coupling site 133 by restricting the lateral motion of the top of module 103.

Signals can flow from chip 118 mounted on substrate 103 to circuit module 150 mounted on printed circuit board 109. The flow of signals between chip 118 and module 150 is best understood by following the conducting pattern from socket coupling site 133 to circuit module 150. Module coupling site 127 is in contact with socket coupling site 133. Conductor 152 couples socket coupling site 133 to socket board contact site 155. A second conductor 158 couples circuit board contact site 155 to circuit module 150.

Figure 3:
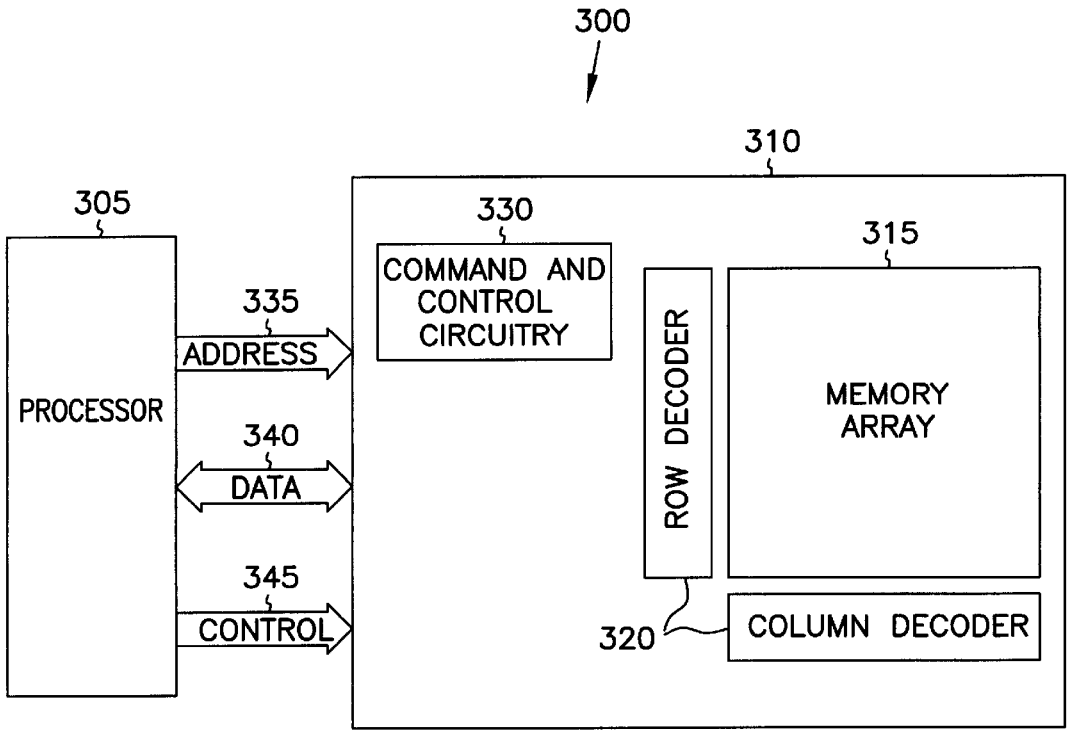
FIG. 3 is a block diagram of a system in which some embodiments of present invention can be practiced.

Referring to FIG. 3, a block diagram of a system level embodiment of the present invention is shown. System 300 comprises processor 305 and memory device 310, which includes memory cells of one or more of the types described above in conjunction with FIGS. 1–2. Memory device 310 comprises memory array 315, address circuitry 320, and read circuitry 330, and is coupled to processor 305 by address bus 335, data bus 340, and control bus 345. Processor 305, through address bus 335, data bus 340, and control bus 345 communicates with memory device 310. In a read operation initiated by processor 305, address information, data information, and control information are provided to memory device 310 through busses 335, 340, and 345. This information is decoded by addressing circuitry 320, including a row decoder and a column decoder, and read circuitry 330. Successful completion of the read operation results in information from memory array 315 being communicated to processor 305 over data bus 340.

Memory circuits or cells, when mounted in the chip carrier system of the present invention, become addressable as elements of memory array 315 in the system shown in FIG. 3.

Conclusion

Embodiments of an apparatus and method for packaging circuits has been described. A module and socket capable of being easily aligned, assembled and interlocked has been described. In an alternative embodiment, a substrate, a chip, and a socket also capable of being easily aligned, assembled and interlocked has been described. In addition, a method of aligning a module with the guide feature of a socket, sliding the module along the edge of the guide, and interlocking the module with the socket has been described.

Although specific embodiments have been illustrated and described herein, it will be appreciated by those of ordinary skill in the art that any arrangement which is calculated to achieve the same purpose may be substituted for the specific embodiment shown. This application is intended to cover any adaptations or variations of the present invention. Therefore, it is manifestly intended that this invention be limited only by the claims and the equivalents thereof.

What is claimed is:

1. An apparatus comprising:

a module having an edge, a coupling site, and an alignment feature located along the edge;

a socket having an edge, an alignment feature, a guide, and a coupling site, wherein the guide is located along the socket edge and is configured for guiding the module alignment feature into contact with the socket alignment feature, as the module is inserted into the socket with the module edge in contact with the guide, and wherein the module coupling site is configured for contacting the socket coupling site when the module alignment feature interlocks with the socket alignment feature; and a chip physically connected to the module and physically and electrically conenected to the socket.

2. The apparatus of claim 1, wherein the module is configured for being inserted into the socket using only a small insertion force.

3. The apparatus of claim 1, wherein the guide is an integral part of the socket.

4. The apparatus of claim 1, further comprising a retaining feature that is an integral part of the socket.

5. The apparatus of claim 4, wherein the retaining feature is a lip to restrict lateral movement of the module.

6. The apparatus of claim 1, wherein the module alignment feature is located along the edge of the module.

7. The apparatus of claim 1, wherein the guide is shaped like an el.

8. The apparatus of claim 1, wherein the socket alignment feature, the guide, and the socket are fabricated as a single integrated component.

9. The apparatus of claim 1, wherein the socket is plastic.

10. An apparatus comprising:

a substrate having an alignment feature;

a socket having a socket alignment feature, a guide, and a retaining feature, wherein the socket is adapted to receive the substrate and aligning the substrate to the socket alignment feature using the guide, adapted to restrict the lateral motion of the substrate using the retaining feature, and adapted to interlock with the substrate by interlocking the socket alignment feature with the substrate alignment feature; and a chip mounted on the substrate and physically and electrically connected to the socket.

11. The apparatus of claim 10, wherein the substrate is a conductor.

12. The apparatus of claim 11, wherein the conductor is adapted to conduct heat away from the chip.

13. The apparatus of claim 11, wherein the conductor is copper.

14. The apparatus of claim 10, wherein the substrate alignment feature is adapted to interlock with the socket alignment feature.

15. The apparatus of claim 10, wherein the substrate alignment feature is a half-cylinder shaped notch.

16. The apparatus of claim 10, wherein the chip is a semiconductor chip.

17. The apparatus of claim 16, wherein the semiconductor chip is a memory chip.

18. The apparatus of claim 10, wherein the chip is mounted on the substrate using an adhesive.

19. The apparatus of claim 10, wherein the guide feature is shaped like an el.

20. The apparatus of claim 10, wherein the guide feature is an integrated element of the socket.

21. The apparatus of claim 10, wherein the retaining feature is an integrated element of the socket.

22. The apparatus of claim 10, wherein the socket alignment feature, the retaining feature, and the guide feature are fabricated as a single integrated component.

23. The apparatus of claim 10, wherein the socket is plastic.

24. The apparatus of claim 10, wherein the retaining feature is integrated with the socket.

25. The apparatus of claim 10, wherein the guide is shaped like an el.

26. The apparatus of claim 10, wherein the socket alignment feature, the guide, and the socket are fabricated as a single integrated component.

27. The apparatus of claim 10, wherein the socket is plastic.

28. A memory system comprising:

a printed circuit board; and an apparatus mounted on the printed circuit board, the apparatus comprising:

a module having an edge, a coupling site, and an alignment feature located along the edge;

a socket having an edge, an alignment feature, a guide, and a coupling site, wherein the guide is located along the socket edge and is configured for guiding the module alignment feature into contact with the socket alignment feature, as the module is inserted into the socket, and wherein the module coupling site is configured for contacting the socket coupling site when the module alignment feature interlocks with the socket alignment feature; and a chip physically connected to the module and physically and electrically connected to the socket.

29. The memory system of claim 28, wherein the module is configured for being inserted into the socket using only a small insertion force.

30. The memory system of claim 28, wherein the guide is an integral part of the socket.

31. The memory system of claim 28, further comprising a retaining feature that is an integral part of the socket.

32. The memory system of claim 31, wherein the retaining feature is a lip to restrict lateral movement of the module.

33. The memory system of claim 28, wherein the module alignment feature is located along the edge of the module.

34. The memory system of claim 28, wherein the guide is shaped like an el.

35. The memory system of claim 28, wherein the socket alignment feature, the guide, and the socket are fabricated as a single integrated component.

36. The memory system of claim 28, wherein the socket is plastic.

37. A memory system comprising:

a printed circuit board; and an apparatus mounted on the printed circuit board, the apparatus comprising:

a substrate having an alignment feature;

a socket having a socket alignment feature, a guide, and a retaining feature, wherein the socket is adapted to receive the substrate and to align the substrate to the socket alignment feature using the guide, and adapted to restrict the lateral motion of the substrate using the retaining feature, and adapted to interlock with the substrate by interlocking the socket alignment feature with the substrate alignment feature; and a chip physically connected to the module and physically and electrically connected to the socket.

38. The memory system of claim 37, wherein the substrate is a conductor.

39. The memory system of claim 38, wherein the conductor is adapted to conduct heat away from the of chip.

40. The memory system of claim 38, wherein the conductor is copper.

41. The memory system of claim 37, wherein the substrate alignment feature is adapted to interlock with the socket alignment feature.

42. The memory system of claim 37, wherein the substrate alignment feature is a half-cylinder shaped notch.

43. The memory system of claim 38, wherein the chip is a semiconductor chip.

44. The memory system of claim 43, wherein the semiconductor chip is a memory chip.

45. The memory system of claim 37, wherein the chip is mounted on the substrate using an adhesive.

46. The memory system of claim 37, wherein the guide feature is shaped like an el.

47. The memory system of claim 37, wherein the guide feature is an integrated element of the socket.

48. The memory system of claim 37, wherein the retaining feature is an integrated element of the socket.

49. The memory system of claim 37, wherein the socket alignment feature, the retaining feature, and the guide feature are fabricated as a single integrated component.

50. The memory system of claim 37, wherein the socket is plastic.

51. The memory system of claim 37, wherein the retaining feature is integrated with the socket.

52. The memory system of claim 37, wherein the guide is shaped like an el.

53. The memory system of claim 37, wherein the socket alignment feature, the guide, and the socket are fabricated as a single integrated component.

54. The memory system of claim 37, wherein the socket is plastic.

55. A computer system comprising:

a processor; and an apparatus coupled to the processor, the apparatus comprising:

a module having an edge, a coupling site, and an alignment feature located along the edge;

a socket, an alignment feature, a guide, and a coupling site, wherein the guide is configured for guiding the module alignment feature into contact with the socket alignment feature as the module is inserted into the socket, and wherein the module coupling site is configured for contacting the socket coupling site when the module alignment feature interlocks with the socket alignment feature; and a chip physically connected to the module and physically and electrically connected to the socket.

56. The computer system of claim 55, wherein the module is configured for being inserted into the socket using only a small insertion force.

57. The computer system of claim 55, wherein the guide is an integral part of the socket.

58. The computer system of claim 55, further comprising a retaining feature that is an integral part of the socket.

59. The computer system of claim 56, wherein the retaining feature is a lip to restrict lateral movement of the module.

60. The computer system of claim 55, wherein the module alignment feature is located along the edge of the module.

61. The computer system of claim 55, wherein the guide is shaped like an el.

62. The computer system of claim 55, wherein the socket alignment feature, the guide, and the socket are fabricated as a single integrated component.

63. The computer system of claim 55, wherein the socket is plastic.

64. A computer system comprising:

a processor; and an apparatus coupled to the processor, the apparatus comprising:

a substrate having an alignment feature;

a socket having an alignment feature, a guide, wherein the socket is adapted to receive the substrate and aligning the substrate to the socket using the guide, and adapted to interlock with the substrate by interlocking the socket alignment feature with the substrate alignment feature; and a chip physically connected to the module and physically and electrically connected to the socket.

65. The computer system of claim 64, wherein the substrate is a conductor.

66. The computer system of claim 65, wherein the conductor is adapted to conduct heat away from the chip.

67. The computer system of claim 65, wherein the conductor is copper.

68. The computer system of claim 64, wherein the substrate alignment feature is adapted to interlock with the socket alignment feature.

69. The computer system of claim 64, wherein the substrate alignment feature is a half-cylinder shaped notch.

70. The computer system of claim 64, wherein the chip is a semiconductor chip.

71. The computer system of claim 70, wherein the semiconductor chip is a memory chip.

72. The computer system of claim 64, wherein the guide feature is shaped like an el.

73. The computer system of claim 64, wherein the guide feature is an integrated element of the socket.

74. The computer system of claim 64, wherein the retaining feature is an integrated element of the socket.

75. The computer system of claim 64, wherein the socket alignment feature and the guide feature are fabricated as a single integrated component.

76. The computer system of claim 64, wherein the socket is plastic.

77. The computer system of claim 64, wherein the retaining feature is integrated with the socket.

78. The computer system of claim 64, wherein the guide is shaped like an el.

79. The computer system of claim 64, wherein the socket alignment feature, the guide, and the socket are fabricated as a single integrated component.

80. The computer system of claim 64, wherein the socket is plastic.

81. An apparatus comprising:

a substrate having an alignment feature;

a socket having a socket alignment feature, a guide, wherein the socket is configured for receiving the substrate and aligning the substrate to the socket alignment feature using the guide and for interlocking with the substrate by interlocking the socket alignment feature with the substrate alignment feature while using only a small insertion force; and at least one chip mounted on the substrate and physically and electrically connected to the socket.

* * * * *

UNITED STATES PATENT AND TRADEMARK OFFICE

CERTIFICATE OF CORRECTION

PATENT NO. : 6,537,100 B2
DATED : March 25, 2003
INVENTOR(S) : Walter L. Moden

It is certified that error appears in the above-identified patent and that said Letters Patent is hereby corrected as shown below:

Title page,
Item [56], U.S. PATENT DOCUMENTS, "5,209,675", delete "Kirsunsky" and insert -- Korsunsky -- therefor.

Column 7,
Line 62, delete "claim 38" and insert -- claim 37 -- therefor.

Column 8,
Line 44, delete "claim 56" and insert -- claim 58 -- therefor.

Signed and Sealed this

Nineteenth Day of August, 2003

JAMES E. ROGAN
*Director of the United States Patent and Trademark Office*